US005288524A

United States Patent [19]

Kramer et al.

[11] Patent Number: 5,288,524

[45] Date of Patent: Feb. 22, 1994

[54] PROCESS FOR COATING HOLLOW BODIES

[75] Inventors: Evert Kramer, Wuppertal; Hans-Jürgen Schlinsog, Wülfrath, both of Fed. Rep. of Germany

[73] Assignee: Herberts G.m.b.H., Wuppertal, Fed. Rep. of Germany

[21] Appl. No.: 847,462

[22] Filed: Mar. 6, 1992

[30] Foreign Application Priority Data

Feb. 8, 1992 [DE] Fed. Rep. of Germany ..... 4203643

[51] Int. Cl.[5] ..... B05D 1/28

[52] U.S. Cl. ..... 427/428; 118/233

[58] Field of Search ..... 118/230, 233, 232; 427/428

[56] References Cited

U.S. PATENT DOCUMENTS 3,563,170 2/1971 Cvacho et al. ..... 118/230
4,111,740 9/1978 Molins et al. ..... 118/233
4,271,216 6/1981 Shimizu ..... 118/230
4,370,943 2/1983 Watanabe et al. ..... 118/233

*Primary Examiner*—Shrive Beck
*Assistant Examiner*—Katherine A. Bareford
*Attorney, Agent, or Firm*—Richard A. Speer

[57] ABSTRACT

Known processes for coating hollow bodies such as cans are problematical in terms of productivity and contamination caused by high rotational speeds of the application rolls due to lacquer splashes and lacquer mist. These problems are solved by means of a process and a device for the application of several coatings to cylindrical hollow bodies by rolling the hollow bodies on an application device having a lacquer film wherein several hollow bodies roll on the lacquer film one after the other and wherein, for the application of at least the first coat of lacquer such hollow body rolls in the lacquer film which is progressively reduced by separation of lacquer on the application of lacquer to the preceding hollow body or bodies.

7 Claims, 2 Drawing Sheets

PROCESS FOR COATING HOLLOW BODIES

The invention relates to a process for the all-round coating of cylindrical hollow bodies by rolling the hollow bodies on an application device having a lacquer film.

It is known that cans can be coated by rolling on a device having a lacquer film. For this a can is inserted in a relatively thick, fresh lacquer film in which it rolls for one or more revolutions plus a narrow overlap region (abbreviated as 1+, 2+, 3+, etc.). Thus the second and subsequent revolutions essentially only affect a distribution or equalization of the lacquer, since about 80% of the lacquer layer aimed at has already been transferred to the can in the first revolution.

Before a further can is coated, the lacquer film on the application device is renewed, based on the principle "always use a complete, fresh lacquer film".

In the region of overlap of cans coated according to this process there is a thicker coat of lacquer which covers better than the coat of lacquer outside the region of overlap; this leads to undesirable 'steps' or visible overlap area.

Attempts have been made to prevent these steps in the region of overlap by allowing the cans to roll significantly more often in the paint film, in order to even out the steps. However, this has the disadvantage that the coating process takes longer, the amount of lacquer coatings transferred to the cans is greater, and coating splashes and lacquer mist are formed to a greater extent, the latter leading to unnecessary contamination of the devices for carrying out this process, and also exposing persons working near these devices to pollutants in a way which is not permissible. Moreover, high loadings of pollutants also arise on the subsequent cleaning of the devices, due to solvents for example.

To increase the productivity of such a process, increases in the rolling speed of the cans on the application device have hitherto always been proposed. By this means, however, the known problems such as lacquer mist, coating splashes, increased cleaning costs for the parts of the equipment contaminated by lacquer mist and coating splashes, and thus the associated increased loading of pollutants in the workplace, are made even more severe.

A device for carrying out this process is known from DE-PS 30 39 812 C3. Such a device has a driven prespin on mandrel wheel, on which the cans are disposed on mandrels which can rotate about their longitudinal axes and which are pressed against a paint or application roll of a coating installation running with its axis parallel to the mandrel wheel and which are guided along the contour of the roll in the region of contact between the cans and the application roll.

If it is required to even out the visually interfering steps in the region of overlap caused by multiple rolling of the cans on the coating rolls of such a device, this is effected with the disadvantage that either fewer cans can be painted per unit of time or that the peripheral speed of the applicator roller must be considerably increased. However a strong formation of lacquer mist occurs at peripheral speeds above about 6 m/sec.

About 600 cans per minute can be coated by means of the process described using the known device without these disadvantages, although the device is theoretically capable of coating up to 2000 cans per minute. In order to coat 1600 cans per minute 3+, a peripheral speed greater than 13 m/sec would be required, for example.

It has also been known (see Prospekt Concord Two-Piece Can Base Coater of ALCOA Ragsdale Machinery Operations, for example) that each can be guided past two applicator rolls. The can is then coated 2+ at the first paint roll and 2+ at the second paint roll. However, for 1600 cans per minute peripheral speeds greater than 13 m/sec still always occur at the second applicator roll, with the known disadvantages.

Moreover these coating installations with two applicator rolls are extremely difficult to adjust, which has led to the operators often using only one roll and keeping the other roll in reserve, e.g., in case the surface of the first roll has to be replaced.

The above-mentioned high throughput rates cannot be achieved with the coatings currently available. The wishes communicated by the operators of such coating devices to the lacquer manufacturers for coatings which splash less cannot be fulfilled without further considerations, since the development of lacquers which splash less is time-consuming and is associated with high costs.

SUMMARY OF THE INVENTION

The object of the invention is therefore to provide a new type of process and a device for carrying out this process for the application of several coats of lacquer to cylindrical hollow bodies by rolling the hollow bodies on an application device having a lacquer film, which enables a large number of cylindrical hollow bodies to be coated per unit of time using currently available coatings, which ensures a very uniform application of coatings over the complete periphery of the hollow body, and which moreover is clean and is gentle to the environment.

To achieve the above-mentioned object a process is provided according to the invention in which several hollow bodies roll on the lacquer film one after the other, wherein, for the application of at least the first (innermost) coat of lacquer, each hollow body rolls in the lacquer film which is progressively reduced by separation of the coating on the application of lacquer to the preceding hollow body or bodies. In contrast to the state of the art, the process according to the invention is thus operated so that several cylindrical hollow bodies, e.g. cans, roll (possibly simultaneously) spatially behind one another and receive a paint film before the latter is renewed. Due to so-called paint splitting/separation, zones are therefore produced in the lacquer film, the film thickness of which progressively decreases. The first (innermost) coat of lacquer is formed on the hollow body by inserting it and rolling it in the zone of the lacquer film with the most extensively reduced thickness. The further coats of lacquer can be formed in the zones of the lacquer film which are becoming progressively thicker, and the last (outermost) coat of lacquer is formed by the fresh lacquer film, which has not yet been subject to lacquer splitting by rolling a preceding hollow body in it.

In general, coats of lacquer of different thicknesses are applied to the hollow body of this means; the thicknesses of these coats can increase from the innermost coat to the outermost coat.

It is particularly advantageous if at least three coats of lacquer are applied to the hollow bodies. However, it is also possible to apply several coats of lacquer, e.g., up to 12.

Furthermore, it is particularly advantageous to roll the hollow bodies several times in each of the zones of the lacquer film which are progressively decreasing in thickness; by this means both a uniform distribution and the thicknesses of the coats can be controlled.

Every customary application device having a lacquer film, for example, an applicator roller, can be used for the process according to the invention.

The hollow bodies can be fed to the application device by means of the usual mandrel wheel, for example.

Rolling in progressively reduced lacquer films according to the invention can be affected, for example, by guiding the applicator roller in the opposite direction to the mandrel wheel.

Cans made of metal such as aluminum or tinplate, such as beer and beverage cans, can be painted by means of this process.

The process according to the invention can be affected with the usual coatings for coating hollow bodies, particularly for coated cans, without these coatings requiring modification. This is particularly important for coating cans for foodstuffs or drinks, for which lacquer components which are toxicologically harmless are used. The coatings which can be used may comprise conventional components, i.e., those which are solvent-based, and also water-based coatings.

A device for carrying out the process according to the invention has an application device having a lacquer film, and a feeding device for feeding the hollow bodies to the application device, on which feeding device the hollow bodies are mounted so that they can rotate, in the same directions so that the application device and the feeding device can move in opposite directions at their point of contact.

It is particularly advantageous to form the application device as an applicator roller and the feeding device as a mandrel wheel which carries a mandrel.

BRIEF DESCRIPTION OF THE DRAWINGS

The process according to the invention will be described in terms of a preferred form of a device for carrying out the process, by means of the drawings, where.

DESCRIPTION OF THE PREFERRED EMBODIMENTS

Figure 1:
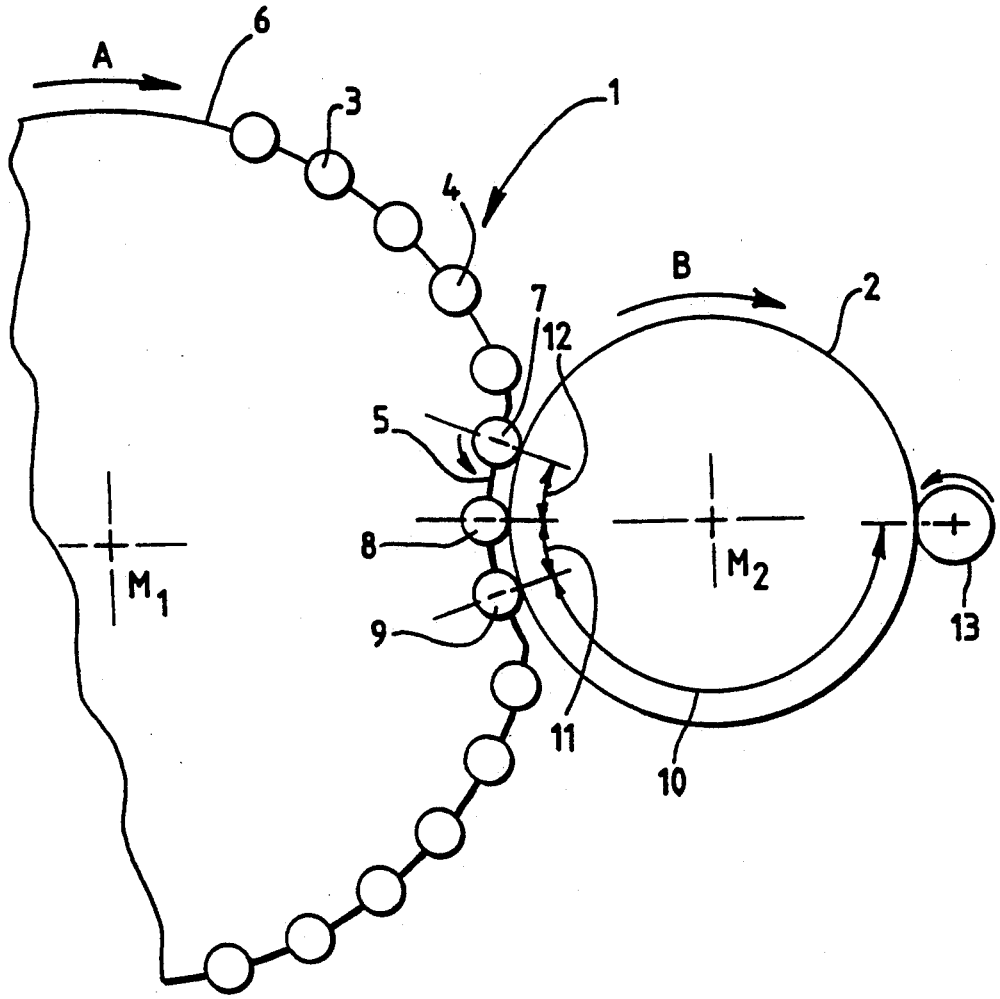
FIG. 1 is a schematic illustration of the mode of operation of the device for carrying out the process.

FIG. 1 shows purely schematically a part of the mandrel wheel (1), which interacts with an applicator roll (2). The mandrel wheel (1) can be driven about its central axis ($M_1$) in the direction of the arrow A and is equipped at its periphery with mandrels (3), which are arranged distributed at uniform distances apart on the periphery of the mandrel wheel (1). The mandrels (3) are mounted in the mandrel wheel so that they can rotate about their longitudinal axes. The cans or other cylindrical hollow bodies (4) are mounted on the mandrels so that they rotate with the latter. They are fed to the mandrels (3) in the known manner, pushed on to these, taken off again after the all-round coating has been effected, and fed to a further processing stage.

The mandrels (3) are held on the mandrel wheel (1) so that they can be moved in a direction transverse to their longitudinal axes by means of a control device-cam, which is not shown in the drawing, for adapting to the path of motion of the applicator roll (2). The latter is driven so that it rotates about its central axis ($M_2$), so that the mandrels from the circular path which is denoted in its entirety by (6) are moved along the path (5) with their central axes in the region of the applicator roller (2) and thus remain pressed in contact with the applicator roller (2), which is driven so that it rotates in the direction of the arrow B.

Coating is affected as follows by means of the process according to the invention:

The coating is applied to the surface of the applicator roller (2) by the usual device, such as a rotogravure cylinder with a doctor or a metering roll (13), and rotates with the applicator roller along the path (10) in the direction of the arrow B. The can (9) rolls in this fresh, thick lacquer layer, takes up part of the lacquer film located on the applicator roller (2) by splitting, e.g., about 50% and receives its final application of lacquer, which in the embodiment illustrated is its third application. However, since the entire coating layer is not transferred to the can (9), there is still a reduced coating layer along the path (11) on the surface of the applicator roller (2). The can (8) rolls in this coating layer, and in this embodiment receives a second application of lacquer of medium coating thickness. This can (8) also does not entirely take up the lacquer film which is still present on the applicator roller (2), so that a lacquer film remains which is further reduced compared with the path (11), this lacquer film moves with the applicator roller (2) along the path (12) in the direction of the arrow B. The can (7) rolls in this thin lacquer film, and receives its first, thin coat of lacquer there. If the path is followed of a can (7) which has just been provided with its first thin coat of lacquer, and which moves along the path (5) in the direction of the arrow A, this then moves to the position of the can (8) and is provided there for a second time with a coat of medium thickness, in order then to move to the position of the can (9) where it receives the final, thickest application of lacquer. Thus, a can which moves along the path (5) receives a total of several coats of lacquer (herein shown as a total of three), with each coat becoming progressively thicker.

The process according to the invention can thus be carried out using known devices, and is merely operated so that the mandrel wheel (1) rotates in the same direction as the applicator roller (2), so that the mandrel wheel (1) and the applicator roller (2) therefore, move in opposite directions at their position of contact. It is, therefore, possible, for example, to use the usual devices simply by changing the direction of rotation of the lacquer station to the mandrel wheel.

Figure 2:
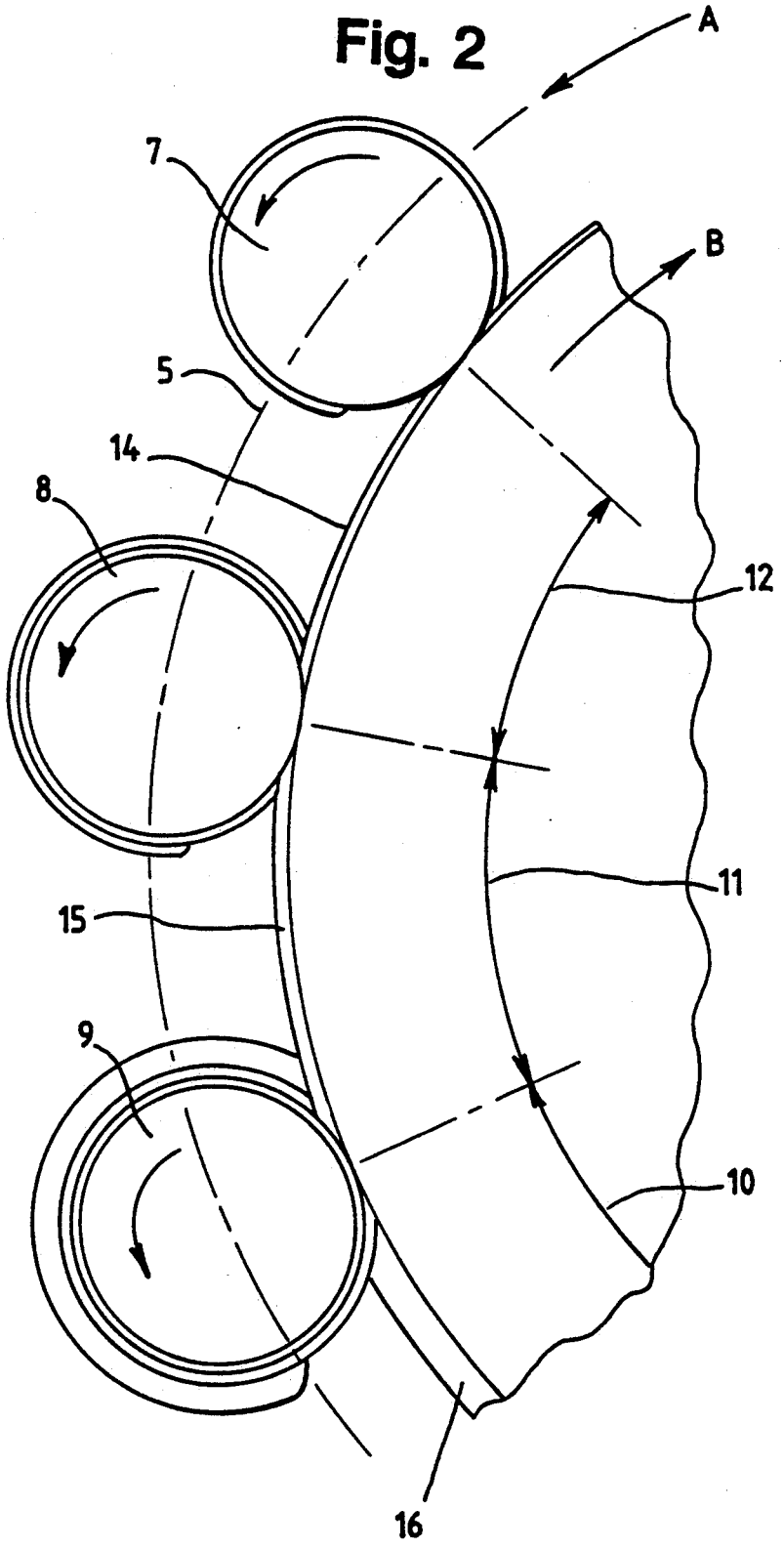
FIG. 2 shows schematically and on a larger scale the conditions for applying lacquer by means of the process according to the invention.

The progressive build-up of lacquer is also shown in FIG. 2. The first, fresh, thick layer of lacquer (16) can be identified in the region (10), the reduced layer of lacquer after rolling of the can is shown in the region (11), and rolling another can—this time the can (8)—leads to the very thin coating layer (14) shown in the 2). This is still sufficient to give a preliminary coat of lacquer to the can (7) which is not yet coated. A can which progresses from the position of the can (7) via the position of the can (8) to the position of the can (9) thus receives a progressive build-up of lacquer comprising three coats. The residual lacquer remaining on the surface of the applicator roller (2) after rolling the can (7) is replenished again by means of an application of lacquer by the rotogravure cylinder and doctor or by the metering roll (13).

The advantages obtainable by means of the process according to the invention are:

Better distribution of the coating. By this means a visually improved result is already obtained with 10–30% less lacquer, leading in turn to a further reduction of costs.

Simpler operation and maintenance, since no difficult adjustment operations are necessary.

A lower peripheral speed (e.g., less than 3 m/sec.). Despite the reduced peripheral speed, the number of cans to be coated per unit of time can be increased (e.g., up to 1600 cans per minute at 3 m/sec.). By this means fewer coating splashes occur, the loading on the environment is reduced, and cleaning operations are reduced, although the coating which were customary up until now can be used unchanged.

Both old and new types of machinery can be converted by reversing the direction of rotation of the lacquer station to the mandrel direction of rotation.

Fewer rejects on start-up of the devices (only about 3–4 cans per interruption).

What is claimed is:

1. A process for the application of several layers of lacquer onto cylindrical hollow bodies by rotating the hollow bodies about axes of rotation and in contact with a lacquer film moved in a first direction on an application device, characterized in that the axes of rotation of the hollow bodies are moved in a second direction opposite the first direction of movement of the lacquer film, one after the other, wherein, for the application of at least a first layer of lacquer onto a hollow body, such hollow body is rolled in a position on the applicator device where an amount of lacquer on the applicator device at that position has been reduced by the application of lacquer from that position onto one or more preceding hollow body or bodies.

2. A process according to claim 1, characterized in that an applicator roller is used as the application device.

3. A process according to claim 2, characterized in that the hollow bodies are fed to the application device by means of a mandrel wheel.

4. A process according to claim 3, characterized in that the lacquer film on the applicator roller moves in the opposite direction to the mandrel wheel rotation in a region where lacquer is applied to the hollow bodies.

5. A process according to claim 1, characterized in that cans are coated as the hollow bodies.

6. A process according to claim 1, characterized in that at least three layers of lacquer are applied to the hollow bodies.

7. In a process for coating substantially cylindrical hollow bodies with a succession of lacquer layers having different thicknesses; the steps comprising:

a) providing lacquer applicator means having a surface for moving lacquer in a first direction from a lacquer supply source to a point of application on hollow bodies;

b) supporting a plurality of hollow bodies for contact with the applicator surface so that the hollow bodies rotate in the same direction as the direction of movement of the lacquer applicator surface upon contact therewith; and c) moving the hollow bodies in a second direction opposite to the first direction of movement of the applicator surface, whereby successive lacquer layers applied to the hollow bodies increase in thickness while the bodies are in contact with the applicator surface.

* * * * *

UNITED STATES PATENT AND TRADEMARK OFFICE

CERTIFICATE OF CORRECTION

PATENT NO. : 5,288,524

DATED : February 22, 1994

INVENTOR(S) : EVERT KRAMER AND HANS-JURGEN SCHLINSOG

It is certified that error appears in the above-identified patent and that said Letters Patent is hereby corrected as shown below:

Column 4, line 58, delete "2)." and insert --region (12).

Signed and Sealed this

Twenty-third Day of August, 1994

Bruce Lehman

*Attest:*

BRUCE LEHMAN

*Attesting Officer*

*Commissioner of Patents and Trademarks*